US008851202B2

(12) United States Patent
Salthaug

(10) Patent No.: US 8,851,202 B2
(45) Date of Patent: Oct. 7, 2014

(54) METHOD AND DEVICE FOR TRANSPORTING PIPESTRINGSECTIONS BETWEEN A STORAGE UNIT AND A DRILL RIG

(75) Inventor: Leif Salthaug, Mandal (NO)

(73) Assignee: Standlifter Holdings AS, Farsund (NO)

( * ) Notice: Subject to any disclaimer, the term of this patent is extended or adjusted under 35 U.S.C. 154(b) by 514 days.

(21) Appl. No.: 13/138,226

(22) PCT Filed: Jan. 15, 2010

(86) PCT No.: PCT/NO2010/000015

§ 371 (c)(1),
(2), (4) Date: Aug. 31, 2011

(87) PCT Pub. No.: WO2010/087710

PCT Pub. Date: Aug. 5, 2010

(65) Prior Publication Data

US 2011/0315446 A1 Dec. 29, 2011

(30) Foreign Application Priority Data

Jan. 27, 2009 (NO) ..... 20090371

(51) Int. Cl.
*E21B 19/00* (2006.01)
*E21B 19/15* (2006.01)
*E21B 19/14* (2006.01)

(52) U.S. Cl.
CPC ..... *E21B 19/146* (2013.01); *E21B 19/155* (2013.01)
USPC ..... 175/52; 166/378; 414/22.54; 414/22.66

(58) Field of Classification Search
USPC ..... 414/22.54, 22.61, 22.66
See application file for complete search history.

(56) References Cited

U.S. PATENT DOCUMENTS 3,083,842 A 4/1963 Bauer et al.
3,157,286 A * 11/1964 Gyongyosi ..... 211/1.53

(Continued)

FOREIGN PATENT DOCUMENTS

RU 1460186 2/1989
WO WO 91/19880 12/1991
WO WO 01/51762 7/2001

OTHER PUBLICATIONS

Salthaug, PCT/NO2010/000015, International Written Opinion, Apr. 22, 2010.

(Continued)

*Primary Examiner* — Jennifer H Gay
*Assistant Examiner* — Caroline Butcher
(74) *Attorney, Agent, or Firm* — Patents + TMS, P.C.

(57) ABSTRACT

A method and a device for transporting pipe string sections (2) between a storage unit (1) wherein the longitudinal axes of the pipe string sections are arranged horizontally and a position of use in a drill rig (32) where the longitudinal axes of the pipe string sections (2) are arranged vertically and where the pipe string sections (2) are displaceable by means of a pipe manipulator (40), and where the method comprises:—positioning a transport frame (14) for pipe string sections (2) at the storage unit (1), as the transport frame (14) is rotatable about a rotary axis (16) which in the position of use is parallel to the pipe string sections (2), and wherein the transport frame (14) is provided with a number of fasteners (18) for the pipe string sections (2); and—displacing a pipe string section (2) from the storage unit (1) and placing the pipe string section (2) in the transport frame (14), alternatively disengaging the pipe string section (2) from the transport frame (14) and placing the pipe string section (2) in the storage unit (1).

20 Claims, 9 Drawing Sheets

(56) References Cited

U.S. PATENT DOCUMENTS

| | | | | |
|---|---|---|---|---|
| 3,336,991 | A * | 8/1967 | Klem et al. | 175/85 |
| 3,913,754 | A * | 10/1975 | Swartz et al. | 414/22.66 |
| 4,445,579 | A * | 5/1984 | Bello | 175/52 |
| 4,892,160 | A * | 1/1990 | Schivley et al. | 175/85 |
| 5,297,642 | A * | 3/1994 | Rajakallio et al. | 175/85 |
| 6,543,551 | B1 * | 4/2003 | Sparks et al. | 175/52 |
| 6,543,555 | B2 | 4/2003 | Casagrande | |
| 2001/0020550 | A1 | 9/2001 | Casagrande | |
| 2003/0159854 | A1 | 8/2003 | Simpson et al. | |
| 2006/0285941 | A1 * | 12/2006 | Fikowski et al. | 414/22.54 |

OTHER PUBLICATIONS

Salthaug, PCT/NO2010/000015, International Search Report, Apr. 26, 2010.

Salthaug, PCT/NO2010/000015, International Peliminary Report, Apr. 27, 2011.

* cited by examiner

IX-IX

XI-XI

METHOD AND DEVICE FOR TRANSPORTING PIPESTRINGSECTIONS BETWEEN A STORAGE UNIT AND A DRILL RIG

This invention relates to a method for transporting pipe string sections between a storage unit and a drill rig. More particularly it concerns a method for transporting pipe string sections between a storage unit where the longitudinal axes of the pipe string sections are arranged horizontally and an operating position in a drill rig where the longitudinal axes of the pipe string sections are arranged vertically so and where the pipe string sections are displaceable by means of a pipe manipulator. The invention also deals with a device for performing the method.

Rationalization in the running in and out of pipe strings in a borehole has, as is known, caused that the pipe string is is divided into pipe string sections comprising several lengths of pipe screwed together. The pipe string sections are normally stored intermediately in a fingerboard in a drill rig when they are not in use.

As work on the drill floor has been automated, a relatively large number of machines are placed on the drill floor and in adjacent areas making such as pipe assembling and disassembling in so-called mouse holes in the drill floor appreciably more difficult.

The weight of pipe string sections being intermediately stored in the drill rig may be considerable and constitutes, for example where a drill ship is concerned, a considerable stability problem. In drilling of deep wells it may also happen that there is not sufficient room in the drill rig for the intermediate storing of all the pipe string sections.

It is known to build and dismantle pipe string sections while the pipe string sections are in a horizontal position and are outside the drill floor. By so doing the pipe string sections may be stored intermediately in the horizontal position before they are brought to or from the drill rig for being connected to or disconnected from the pipe string. U.S. Pat. No. 3,887,086 describes a device where the pipe string sections that are stored horizontally are individually displaced having their upper end portion in working position toward the drilling centre, before the upper end portion is lifted up into the drill rig. The device of U.S. Pat. No. 3,887,086 remedies the intermediate storage problem, but increases considerably the necessary time being used for the transport the pipe string sections.

The object of the invention is to remedy or reduce at least one of the disadvantages of the prior art.

The object is achieved in accordance with the invention and by virtue of the features disclosed in the following description and in the subsequent claims.

A method is provided for transporting pipe string sections between a storage unit where the longitudinal axes of the pipe string sections are arranged horizontally and an operating position in a drill rig where the longitudinal axes of the pipe string sections are arranged vertically and where the pipe string sections are displaceable by means of a pipe manipulator. The method is characterised in that it comprises:

- placing a transport frame for pipe string sections at the storage unit, as the transport frame is rotatable about a rotary axis that in the working position is parallel to the pipe string sections, and wherein the transport frame is provided with a number of fasteners for the pipe string sections; and
- displacing a pipe string section from the storage unit and placing the pipe section in the transport frame, alternatively detaching the pipe string section from the transport frame and placing the pipe string section in the storage unit.

The method may further comprise rotating the transport frame about the rotary axis until at least one of the fasteners corresponds with a storage position in the storage unit.

By the transport frame being rotated, preferably indexed, the work of loading and unloading connected with the transport frame is facilitated.

The method may comprise displacing the transport frame with pipe string sections fastened thereon between the storage unit and the drill rig. The number of pipe string sections connected to the transport frame may be relatively large, reducing to a large extent the transport time compared to prior art.

The method may further comprise indexing of the transport frame until the transport frame fastener corresponds with a gripping position of a pipe manipulator, and displacing the pipe string section between the transport frame and a drilling centre.

The transport frame may thus be positioned in favourable positions both at the storage unit and in the drill rig. Arrangement is thus made to be able to rotate the transport frame about its rotary axis both to ease loading and unloading work at the storage unit and at the pipe manipulator in the drill rig.

The pipe string sections may in one embodiment be positioned side by side in the storage unit. The pipe string sections may be displaced between the storage unit and the transport frame; whereafter the transport frame is rotated about its rotational axis at the same time as the transport frame is displaced to the next storage unit position.

A storage unit wherein the pipe string sections are positioned side by side may be appropriate when pipes are assembled to pipe string sections at the storage unit. The pipe string sections may thereby be transported between the make up tool, which may be constituted by a power tong, and the storage unit for example by means of a bridge crane.

In another embodiment the storage unit may be constituted by a structure wherein the pipe string sections are lying on top of each other and wherein such as an actuator displaces the pipe string sections to a position suitable for transfer to the transport frame.

A storage unit wherein the pipe string sections are placed on top of each other may be appropriate if the assembly and disassembly of pipe string sections is to take place remote from the transport frame. Complete storage units of this kind may for example be transported from shore by a vessel and lifted into position at the transport frame. A storage unit of this kind requires also relatively little space.

It is also possible to displace pipe string sections between the storage unit and the transport frame by means of a manipulator.

It may be advantageous to displace several pipe string sections between the storage unit and the transport frame simultaneously.

The method may be performed by means of a device for transport of pipe string sections between a storage unit wherein the longitudinal axes of the pipe string sections are arranged horizontally, and a position in a drill rig wherein the longitudinal axes of the pipe string sections are arranged vertically and wherein the pipe string sections are displaceable by a pipe manipulator. The device is characterised in that a transport frame for pipe string sections at least in its loading or unloading position is rotatable about an axis of rotation in the position of use being parallel with the pipe string sections, as the transport frame is provided with fasteners for pipe string sections.

A number of fasteners for pipe string sections may be distributed about the transport frame. Each of the fasteners are arranged to be able to hold a pipe string section in a certain position in the transport frame.

The fastener may comprise one locking element, which in one embodiment is displaceable between a first position wherein the locking element is in engagement with a pipe string section being in the storage unit, and a second position wherein the locking element holds the pipe string section in the fastener. Advantageously three or more locking elements distributed along the length of the pipe string section are utilised, at least one locking element being arranged to be able to take up forces in the longitudinal direction of the pipe string section.

The locking element may be displaceable in chiefly the radial direction relative to the rotary axis to be able to be displaced from an inactive position to the first or second position, and also between the first and second position.

The locking element may be rotatable about an essentially radial axis to be rotatable between freewheeling and meshing with its respective pipe string section.

The transport frame may be provided with transport means to be displaceable between the storage unit and the drill rig.

By utilising more than one transport frame the pipe string sections may for example be loaded into a transport frame in the drill rig while pipe string sections simultaneously are unloaded from another transport frame at the storage unit.

It may be appropriate to let two transport frames be displaced between the storage unit and the drill rig by means of separate transport means, which may for example comprise separate tracks.

The method and the device of the invention make, by means of relatively simple means, a relatively speedy transport of pipe string section from a horizontal storage unit to a drill rig possible.

In the following is described an example of a preferred method and embodiment illustrated in the accompanying drawings, wherein.

Figure 1:
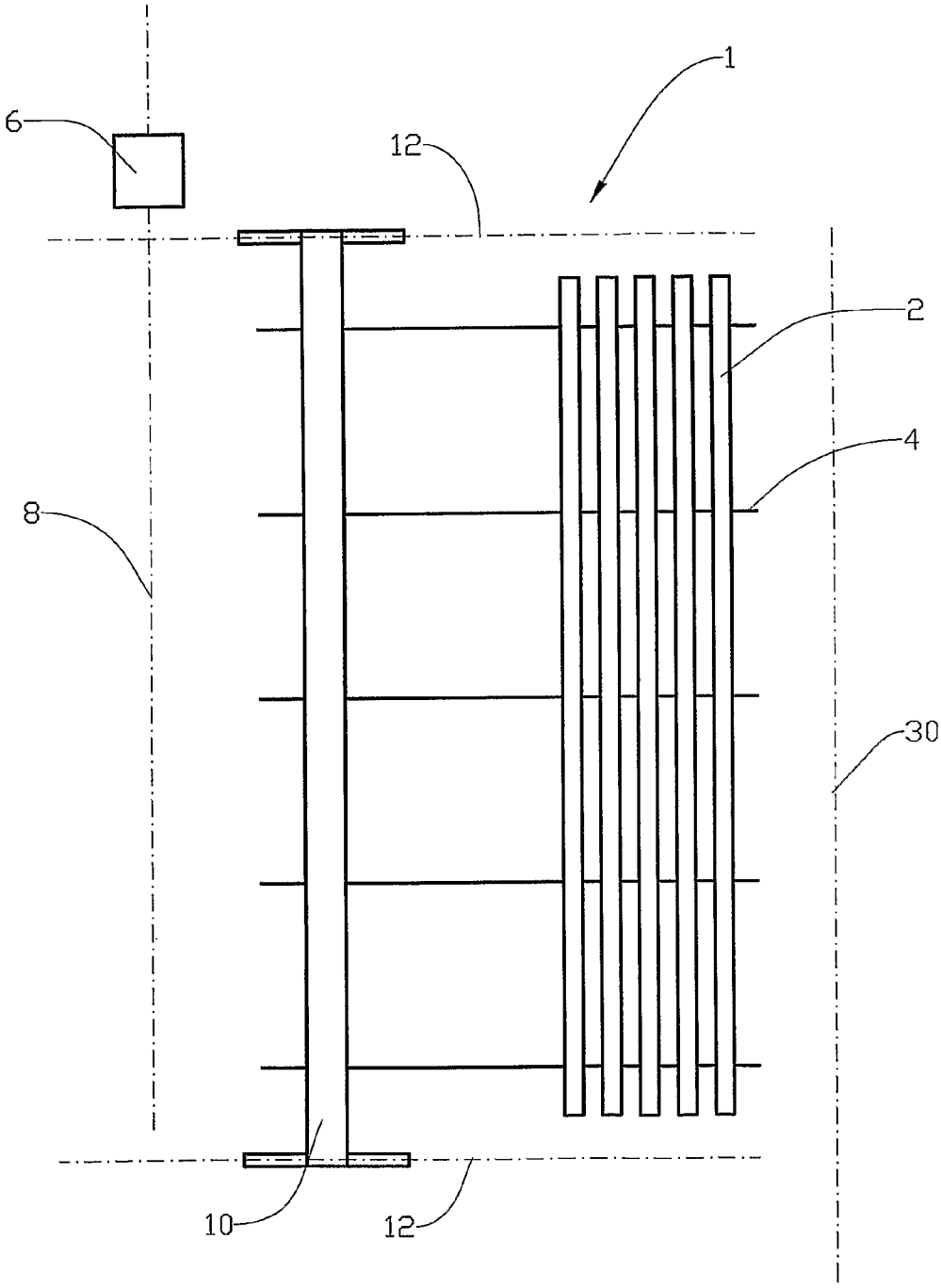
FIG. 1 shows schematically a plan view of a horizontal storage unit where pipe string sections are placed side by side.

In the drawings the reference numeral 1 indicates a storage unit for pipe string sections 2 wherein the pipe string sections 2 are placed on support rails 4.

A horizontal power tong 6 for assembling and disassembling pipe string sections 2 is arranged at the storage unit 1, as pipe string sections 2 are led through the power tong 6 along a transport axis 8. A bridge crane 10 is used for transporting pipe string sections 2 between the storage unit 1 and the transport axis 8. The bridge crane 10 is displaced along crane rails 12.

Figure 2:
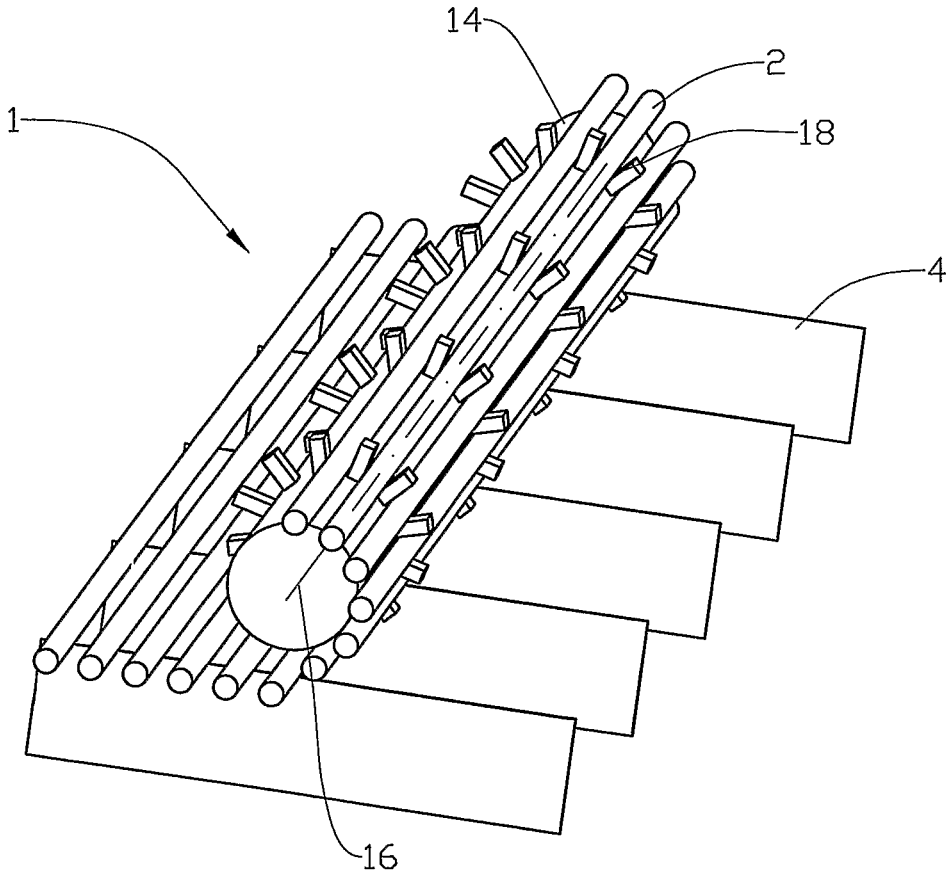
FIG. 2 shows a principle sketch where pipe string sections are in the process of being transferred from the storage unit to a transport frame.

A transport frame 14 is shown schematically in FIG. 2. The transport frame 14, which is rotatable about a longitudinal rotary axis 16, is along its circumference provided with a number of fasteners 18 for pipe string sections 2. The transport frame 14 is supported in not shown wheel fasteners that are displaced along the crane rails 12.

Figure 3:
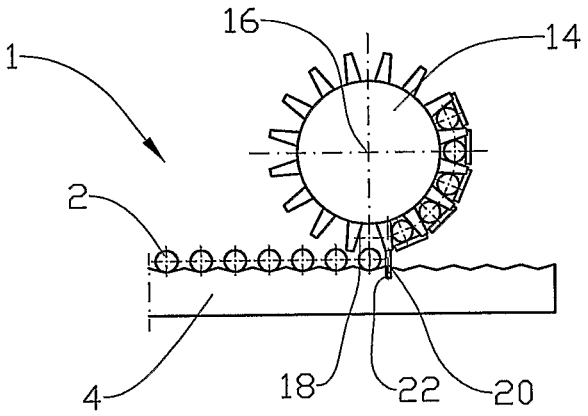
FIG. 3 shows schematically an end view of the storage unit and the transport frame in FIG. 2 and where a locking element is displaced out from the transport frame.

Each fastener 18 is designed with an angular locking element 20, which is hydraulically displaceable in an essentially radial direction, and which is hydraulically rotatable about an essentially radial axis 22, see FIG. 3.

Figure 5:
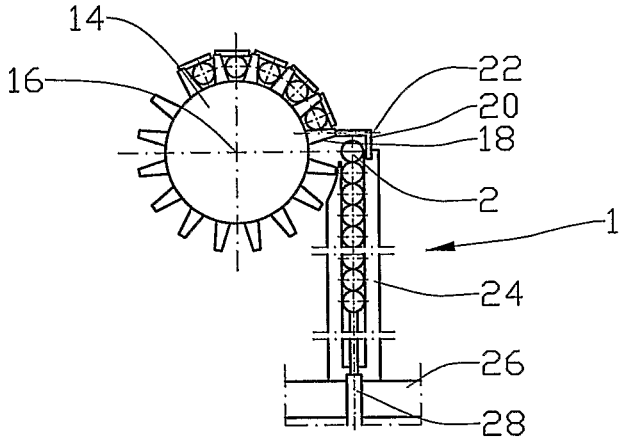
FIG. 5 shows schematically an end view of a storage unit and a transport frame where pipe string sections are placed on top of each other in the storage unit and where the locking element is brought into gripping position relative to the upper pipe string section in the storage unit.
Figure 6:
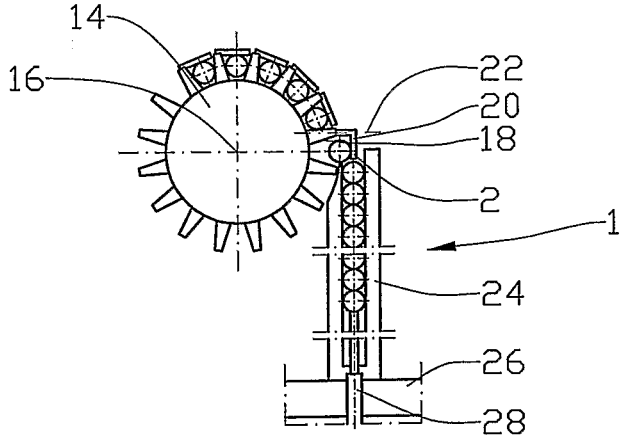
FIG. 6 shows the same as in FIG. 5, but here the upper pipe string section in the storage unit is under displacement in toward the transport frame.

In an alternative embodiment the storage unit 1 is constituted by a number of interconnected, in a row standing, U-shaped elements 24 where pipe string sections 2 are arranged on top of each other, see FIGS. 5 and 6. The elements 24 are placed on a foundation 26. A number of actuators 28 are fastened to the foundation 26 and designed to be able to lift the pipe string sections 2 upward in the elements 24.

A transport rail 30 runs from the storage unit 1 and up into a drill rig 32. A number of wheel boxes 34 running on the transport rail 30 are connected to the transport frame 14. The wheel boxes 34 are displaced along the transport rail 30 in a per se known way for example by a not shown wire drive or a rack-and-pinion drive.

A rotary coupling 36 is arranged in the drill rig 32. In this preferred embodiment the rotary coupling 36 is provided with a first set of rotating arms 38 arranged to be connectable to the transport frame 14 to rotate this between a position where the transport frame 14 is connected to the transport rail 30, see FIG. 10, and an active position in the drill rig 32, see FIG. 11, where a pipe manipulator 40 may be connected to a pipe string section 2 positioned in the transport frame 14.

Figure 12:
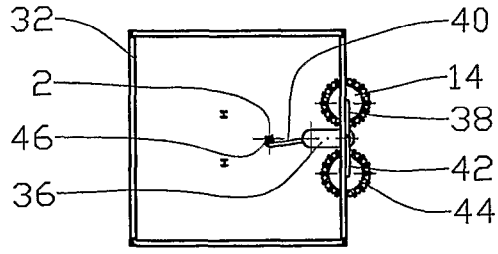
FIG. 12 shows the same as in FIG. 11, but here the pipe manipulator has displaced a pipe string section to a drill centre.
Figure 13:
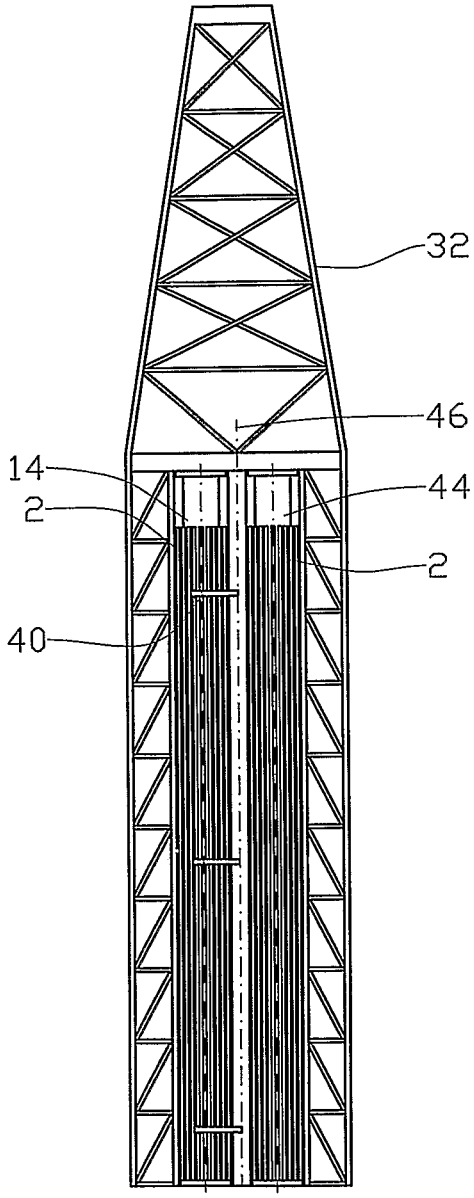
FIG. 13 shows schematically a section XI-XI in FIG. 11.

A second set of rotating arms 42 are arranged to be connectable to a second transport frame 44 and to rotate this to its active position in the drill rig 32, see FIG. 12.

The pipe manipulator 40 is designed to be able to displace a pipe string section 2, also in an axial direction, from the transport frame 14 and to a drilling centre 46 where the pipe string section 2 may be delivered. In reverse order the pipe manipulator 40 may fetch pipe string sections 2 from the drilling centre 46.

The figures do not show necessary adjoining equipment, which will be known to a person skilled in the art, and need thus not to be further described.

Figure 4:
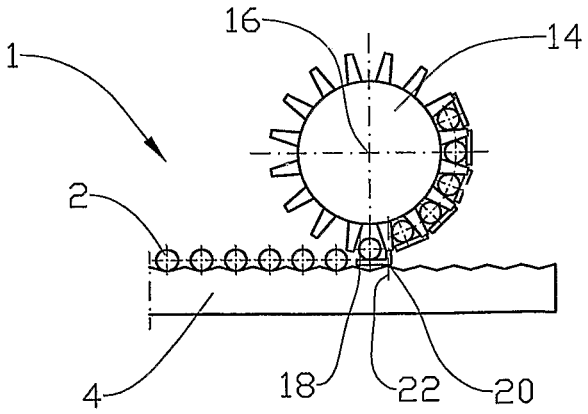
FIG. 4 shows the same as FIG. 3, but here the locking element is rotated into engagement with a pipe string section, as the pipe string section is under displacement toward the transport frame.

When there is a need for pipe string sections 2 in the drill rig 32, the transport frame 14 is placed in position at the storage unit 1. If the storage unit 1 is designed such that the pipe string sections 1 are arranged side by side, see FIG. 1-4, the transport frame 14 is rotated about the rotary axis 16 until a fastener 18 corresponds with a pipe string section 2 in the storage unit 1. The locking elements 20 belonging to the relevant fastener 18 are subsequently displaced in a radial direction outwards, see FIG. 3. The locking elements 20 are rotated about the axis 22 until the locking elements 20 come into engagement with the pipe string section 2. The locking elements 20 are then displaced in a radial direction inwards and thereby pulling the pipe string section 2 in toward the transport frame 14, see FIG. 4. The locking elements 20 hold the pipe string sections 2 secured in the fastener 18. The transport frame 14 is then displaced horizontally at the same time as it is rotated about the rotary axis 16 until the next fastener corresponds with the next pipe string section 2 in the storage unit 1 whence the connecting is repeated.

If the storage unit 1 is designed so that the pipe string sections 2 are lying on top of each other, see FIGS. 5-6, the pipe string sections 2 are displaced by means of the actuators 28 until the upper pipe string section 2 is in a favourable position for transfer to the transport frame 14. The transport frame 14 is rotated about the rotary axis 16 until a fastener 18 corresponds with the upper pipe string section 2 in the storage unit 1, see FIG. 5.

Connecting of the pipe string section 2 on to the transport frame 14 is performed in a corresponding way to what is described above, see FIG. 6.

Figure 7:
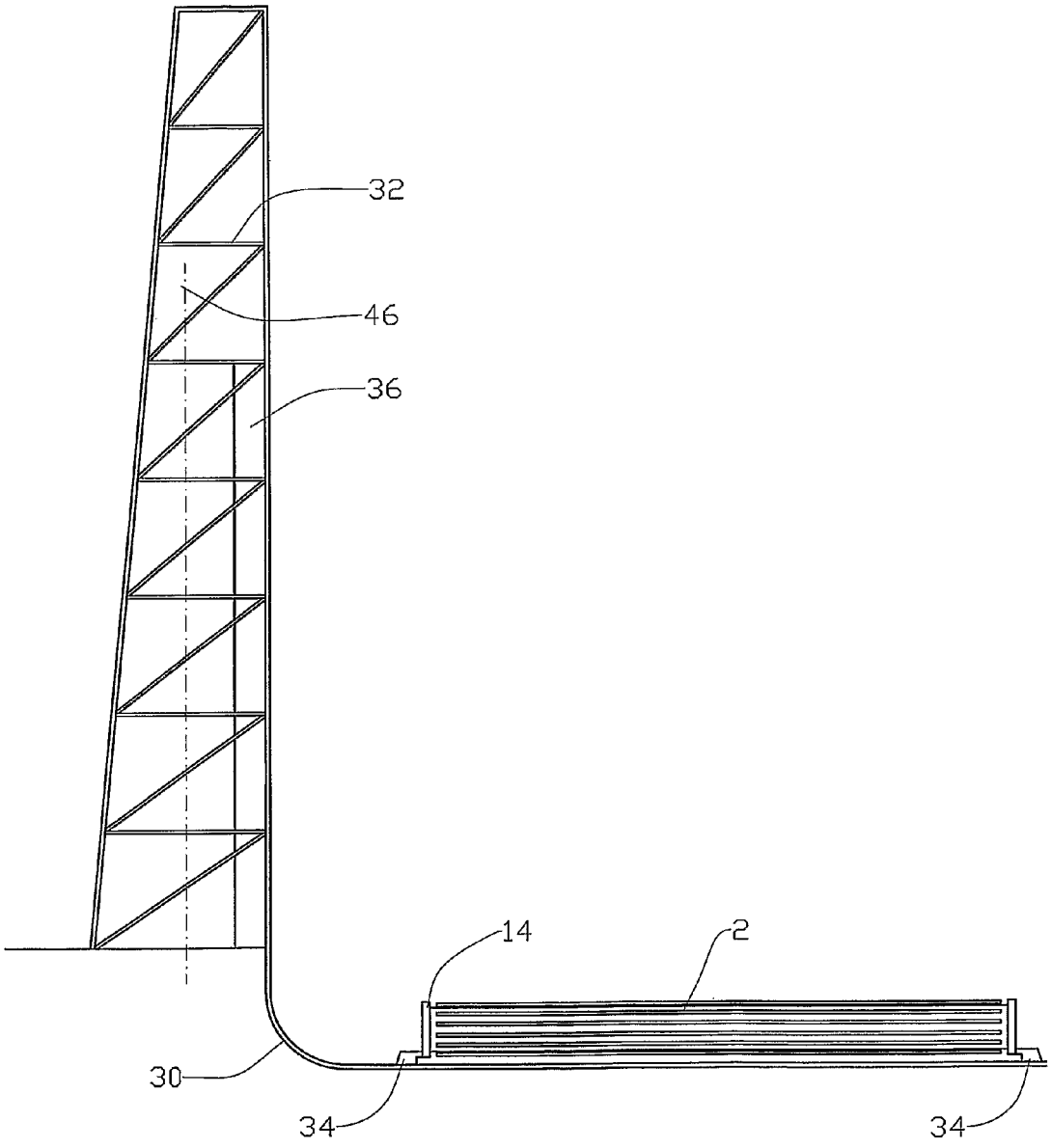
FIG. 7 shows schematically and to a smaller scale a side view wherein the transport frame, being at the storage unit, is connected to transport means to be able to be displaced to a drill rig.
Figure 8:
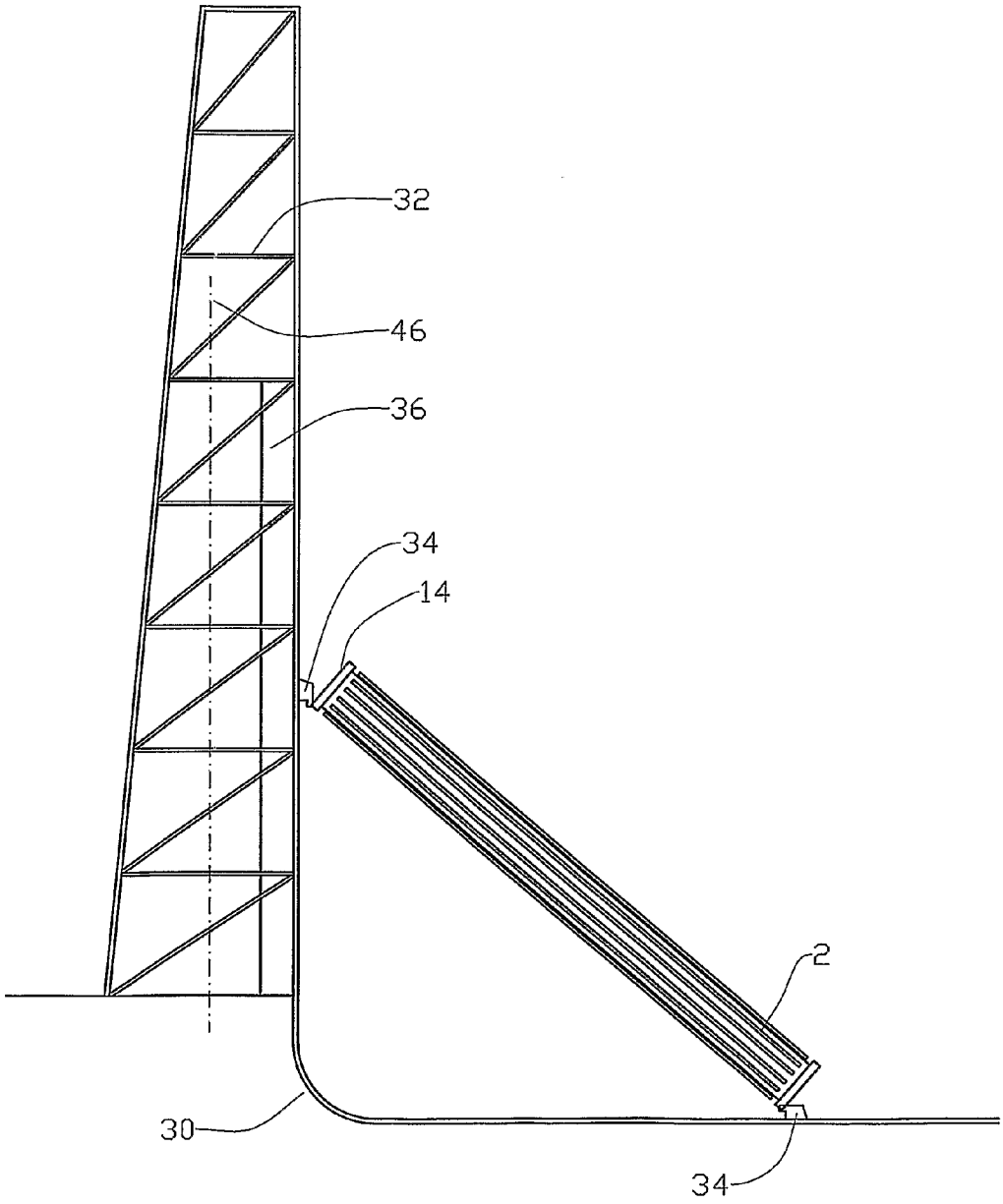
FIG. 8 shows the same as in FIG. 7, but here the transport frame is en route up into the drill rig.
Figure 9:
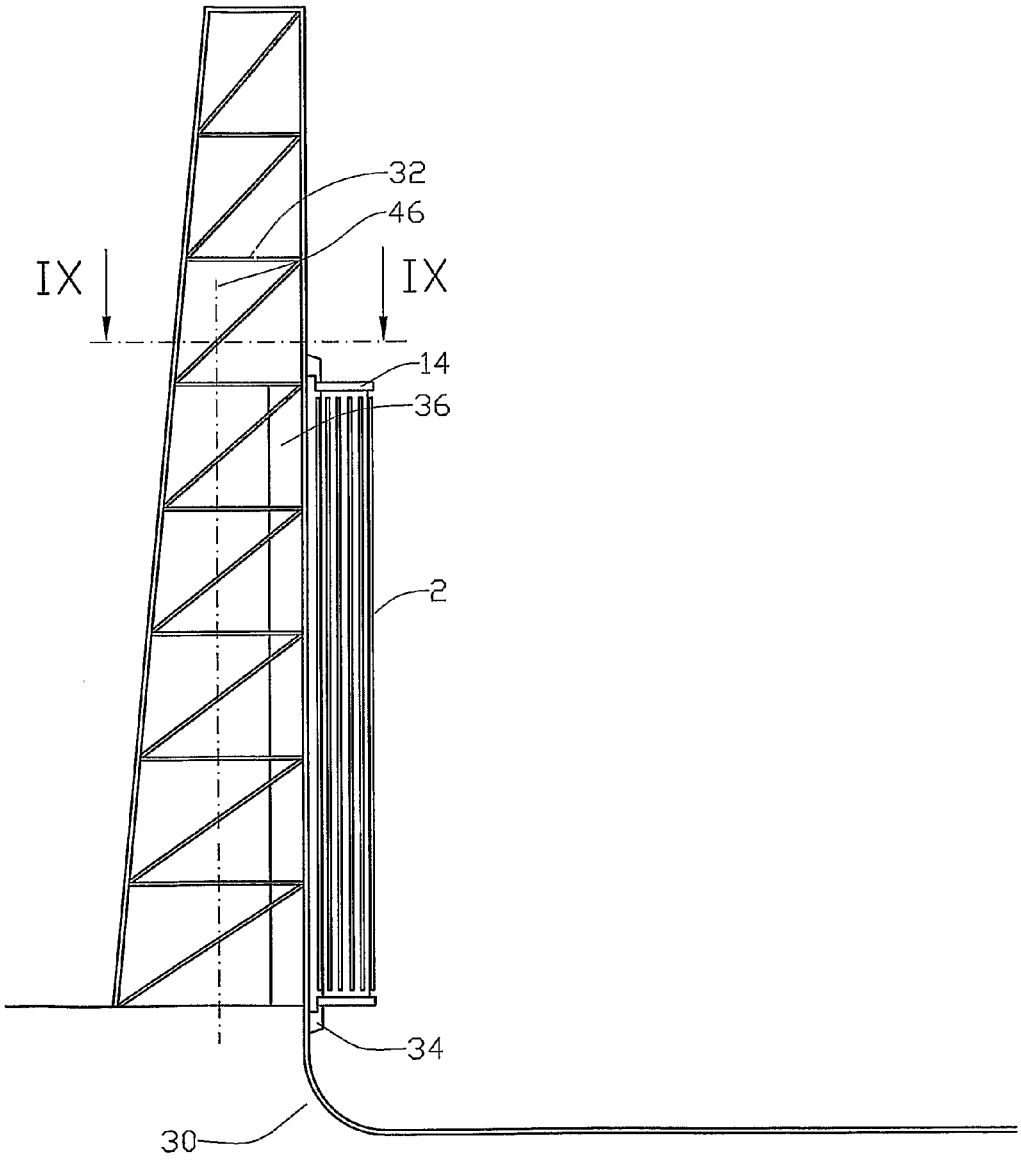
FIG. 9 shows the same as in FIG. 7, but here the transport frame is placed in the drill rig.

When the desired number of pipe string sections 2 is fastened to the transport frame 14, the transport frame 14 is connected to the wheel boxes 34. The transport frame 14 is then displaced along the transport rail 30 forward to the drill rig 32, see FIG. 7-9.

Figure 10:
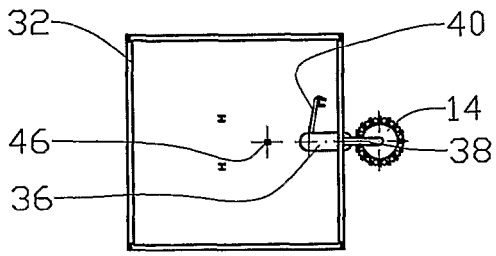
FIG. 10 shows a schematic section IX-IX in FIG. 9 of the drill rig and wherein the transport frame is connected to a rotary coupling.
Figure 11:
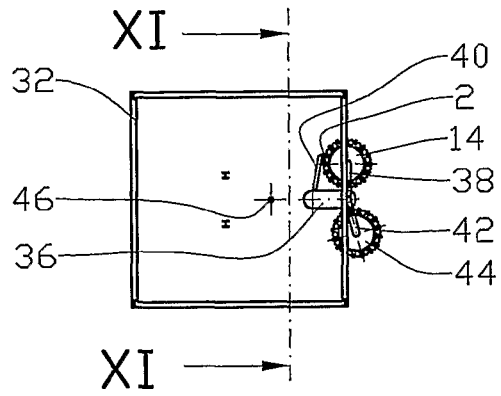
FIG. 11 shows the same as in FIG. 10, but here the transport frame is rotated to its working position in the drill rig, as the pipe manipulator is en route to fetch a pipe string section out from the transport frame, and wherein a second transport frame has arrived at the drill rig and is under rotation in to its position of use on the opposing side of the rotary coupling.

In the drill rig 32 the transport frame 14 is connected to the first rotating arms 38 of a rotary coupling 36, whereafter the transport frame 14 is rotated to its active position in the drill rig 32, see FIGS. 10-11.

A pipe string section 2 is gripped in a per se known way by the pipe manipulator 40, whereafter the locking elements 20 holding the relevant pipe string section 2 is displaced to their inactive positions. The pipe manipulator 40 is subsequently rotating the pipe string section 2 to the drilling centre 46, see FIG. 11.

Before the next pipe string section 2 is to be transferred to the drilling centre 46, the transport frame 14 rotates about the rotary axis 16 until the next pipe string section 2 corresponds with the engagement position of the pipe manipulator 40.

When pipe string sections 2 are to be removed from the drilling centre 46, the operations are carried out in the reverse order.

The invention claimed is:

1. A method for transporting pipe string sections between a storage unit wherein longitudinal axes of the pipe string sections are arranged horizontally, and a drill rig wherein the longitudinal axes of the pipe string sections are arranged vertically and further wherein the pipe string sections are displaceable by means of pipe manipulator, the method comprising the steps of:

positioning a transport frame for the pipe string sections at the storage unit wherein the transport frame is rotatable about a rotary axis that is parallel to the pipe string sections wherein the transport frame is provided with a number of fasteners for the pipe string sections;

advancing the transport frame along the storage unit in a direction perpendicular to the longitudinal axes of the pipe string sections;

completing one step of the group consisting of (a) displacing one of the pipe string sections from the storage unit and placing the one of the pipe string sections in the transport frame and (b) disengaging one of the pipe string sections from the transport frame and placing the one of the pipe string sections in the storage unit;

displacing the transport frame with the pipe string sections fixed in position between the storage unit and the drill rig; and rotating the transport frame about the rotary axis until at least one of the fasteners corresponds with a storage position in the storage unit.

2. The method of claim 1 further comprising the steps of:

indexing the transport frame about the rotary axis until one of the fasteners corresponds with a gripping position of the pipe manipulator; and displacing one of the pipe string sections.

3. The method of claim 1 further comprising the step of:

rotating the fasteners about a radial axis wherein the fasteners are distributed radially about the transport frame.

4. The method of claim 1 further comprising the steps of:

connecting the transport frame to a rotary coupling wherein the rotary coupling is connected to the drill rig;

rotating the transport frame; and displacing the pipe string sections with the pipe manipulator.

5. The method of claim 1 further comprising the step of:

moving the transport frame on the storage unit in the direction perpendicular to the longitudinal axes of the pipe string sections.

6. The method of claim 1 further comprising the step of:

arranging the storage unit at a distance from the drill rig.

7. A device for transporting pipe string sections between a storage unit wherein longitudinal axes of the pipe string sections are arranged horizontally, and a drill rig wherein the longitudinal axes of the pipe string sections are vertically arranged wherein the pipe string sections are displaceable by means of a pipe manipulator, the device comprising:

a transport frame that is rotatable about a rotary axis that is parallel with the pipe string sections;

a plurality of cavities within the transport frame wherein rotation of the transport frame radially aligns the cavities with the pipe string sections on the storage unit; and a plurality of fasteners on the transport frame for the pipe string sections wherein each of the plurality of fasteners has a locking element that is displaceable in a radial direction relative to the rotary axis.

8. The device of claim 7 wherein the plurality of fasteners are distributed about the transport frame.

9. The device of claim 7 wherein the locking element is displaceable between a first position wherein the locking element is in engagement with one of the pipe string sections in the storage unit and a second position wherein the locking element holds the one of the pipe string sections in one of the plurality of fasteners.

10. The device of claim 7 wherein the locking element is rotatable about a radial axis.

11. The device of claim 7 further comprising:

transport means to displace the transport frame between the storage unit and the drill rig.

12. The device of claim 7 wherein the transport frame is movable in a linear direction perpendicular to the longitudinal axes pipe string sections.

13. The device of claim 7 wherein each of the plurality of fasteners on the transport frame corresponds to each of the cavities in the transport frame.

14. The device of claim 7 further comprising:

a rotary coupling connected to the drill rig wherein the rotary coupling is connectable to the transport frame wherein the pipe manipulator displaces the pipe string sections.

15. The device of claim 7 further comprising:

a plurality of interconnected U-shaped elements wherein the pipe string sections are arranged vertically within the U-shaped elements wherein actuators raise the pipe string sections into the transport frame.

16. The device of claim 7 wherein the storage unit is arranged at a distance from the drill rig.

17. A system for transporting pipe string sections between a storage unit and a drill rig, the system comprising:

a transport frame having a plurality of cavities wherein the transport frame is rotatable about a rotary axis and further wherein the transport frame is movable on the storage unit in a direction perpendicular to longitudinal axes of the pipe string sections;

fasteners connected to the transport frame wherein the fasteners secure the pipe string sections within the plurality of cavities of the transport frame; and a transport rail connected to the drill rig and to the storage area wherein the transport frame is displaced along the transport rail between the storage unit and the drill rig.

18. The system of claim 17 further comprising:

a rotary coupling connected to the drill rig wherein the rotary coupling is connectable to the transport frame and further wherein the rotary coupling rotates the transport frame.

19. The system of claim 17 further comprising:

a rotary coupling connected to the drill rig; and rotating arms connected to the rotary coupler wherein the rotating arms rotate the transport frame.

20. The system of claim 17 further comprising:

a rotary coupling connected to the drill rig; and a pipe manipulator connected to the rotary coupling wherein the pipe manipulator displaces the pipe string sections.

* * * * *